US005182856A

United States Patent [19]

Armbruster

[11] Patent Number: 5,182,856

[45] Date of Patent: Feb. 2, 1993

[54] HEAT EXCHANGER

[75] Inventor: Horst Armbruster, Illingen, Fed. Rep. of Germany

[73] Assignee: Behr GmbH & Co., Fed. Rep. of Germany

[21] Appl. No.: 809,142

[22] Filed: Dec. 18, 1991

[30] Foreign Application Priority Data

Dec. 28, 1990 [DE] Fed. Rep. of Germany ..... 4042019

[51] Int. Cl.[5] ..... B23P 15/26; F01P 11/08; F28F 3/08

[52] U.S. Cl. ..... 29/890.039; 29/890.03; 29/890.054; 165/167; 165/51; 165/916; 123/41.33

[58] Field of Search ..... 165/165, 166, 167, 916, 165/51; 184/104.3; 123/196 AB, 41.33; 277/235 A, 235 B; 29/890.039, 890.03, 890.054

[56] References Cited

U.S. PATENT DOCUMENTS

| | | | |
|---|---|---|---|
| 3,727,681 | 4/1973 | Fernandes | 165/158 |
| 3,737,169 | 6/1973 | Glynn | 277/235 B |
| 4,271,901 | 6/1981 | Buchmuller | 165/166 |
| 4,471,968 | 9/1984 | Schlaupitz et al. | 277/235 B |
| 4,561,494 | 12/1985 | Frost | 165/76 |
| 4,580,625 | 4/1986 | Yamanaka et al. | 165/167 |
| 4,669,532 | 6/1987 | Tejima et al. | 165/167 |
| 4,696,339 | 9/1987 | Schwarz | 165/51 |
| 4,720,316 | 1/1988 | Ruoff | 277/235 B |
| 4,967,835 | 11/1990 | Lefeber | 165/167 |
| 4,968,045 | 11/1990 | Abe et al. | 277/235 B |
| 5,004,249 | 4/1991 | Grosch et al. | 277/235 B |

FOREIGN PATENT DOCUMENTS

| | | |
|---|---|---|
| 0124217 | 11/1984 | European Pat. Off. . |
| 3247502 | 7/1984 | Fed. Rep. of Germany . |
| 3733866 | 4/1989 | Fed. Rep. of Germany . |
| 3815070 | 11/1989 | Fed. Rep. of Germany . |
| 3902786 | 8/1990 | Fed. Rep. of Germany . |
| 3913100 | 10/1990 | Fed. Rep. of Germany . |

*Primary Examiner*—John Rivell
*Assistant Examiner*—L. R. Leo
*Attorney, Agent, or Firm*—Evenson, Wands, Edwards, Lenahan & McKeown

[57] ABSTRACT

Known disk oil coolers, which are surrounded by a plastic covering, require high expenditures during manufacturing because the sealing-off with respect to the front-side connections of the covering must take place by soldering. A pot-shaped housing is disclosed with a lid made of plastic which is welded together and into which, on both sides, sealing devices are fitted for the sealing-off of the stack of disks, in which case the design is such that, after the welding-together, the sealing devices are each prestressed.

5 Claims, 4 Drawing Sheets

Fig. 1
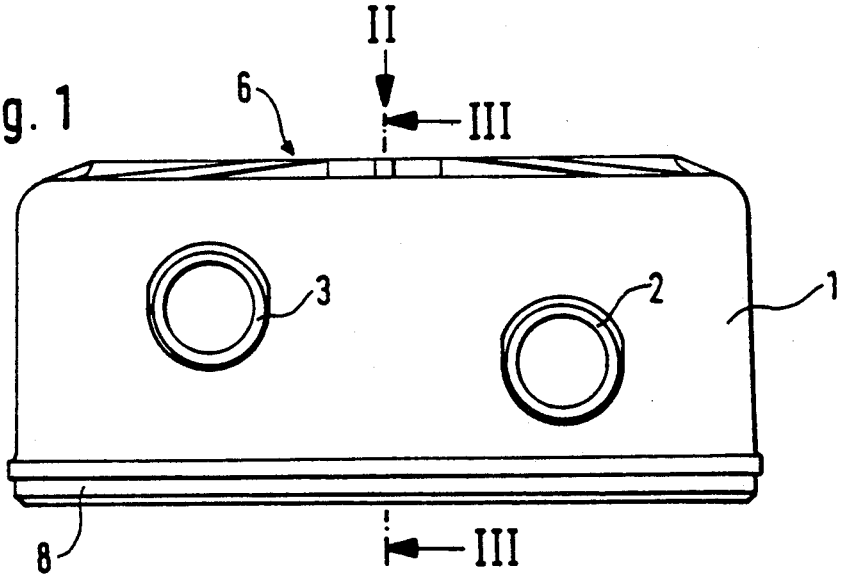
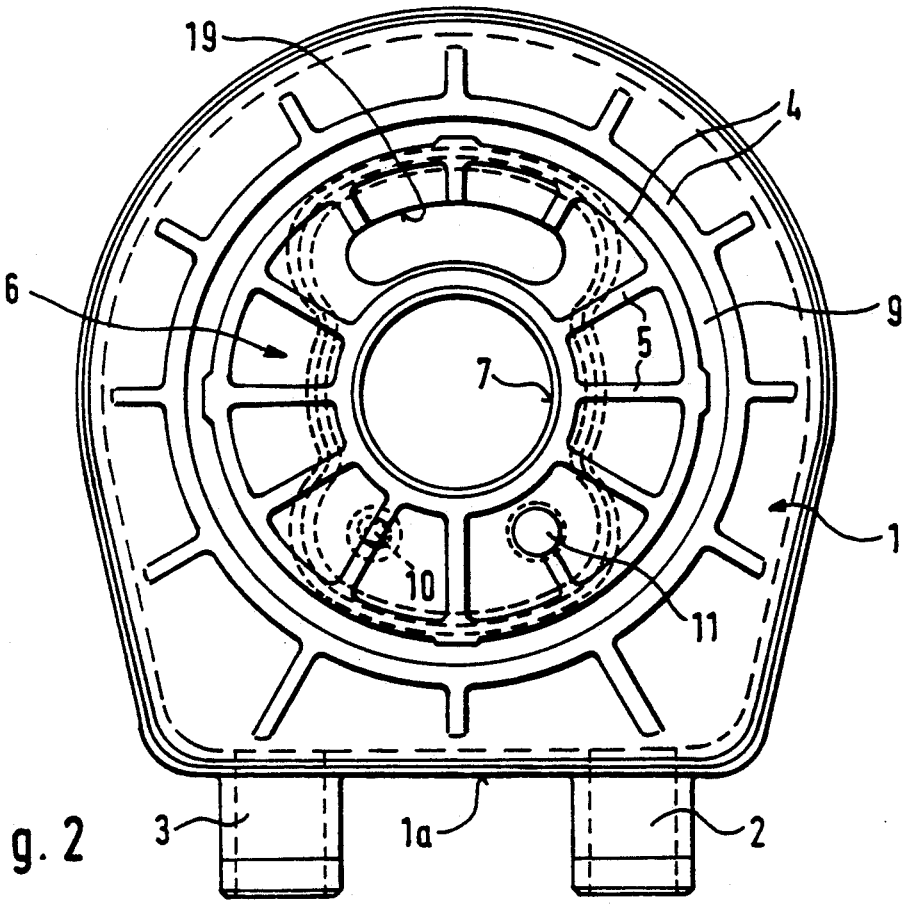
Fig. 2

Fig. 3
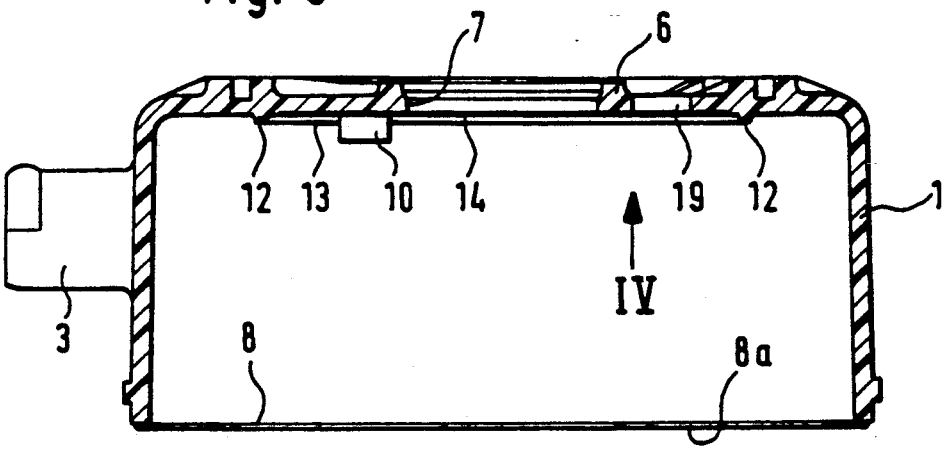
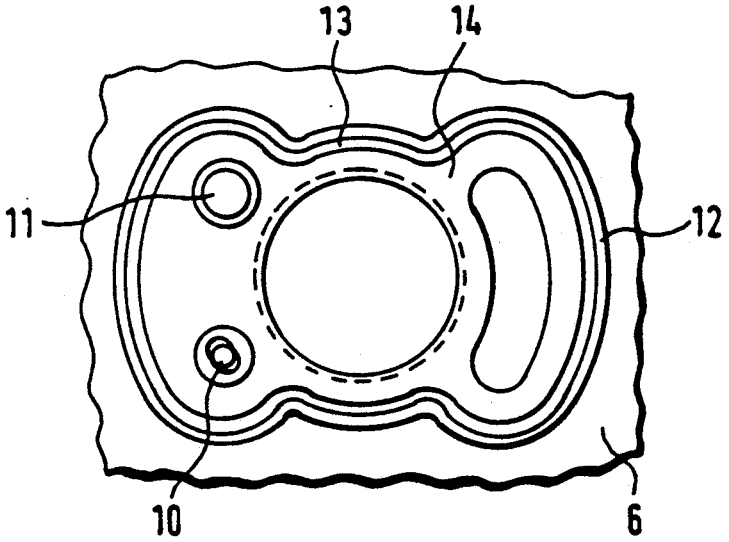
Fig. 4
Fig. 5
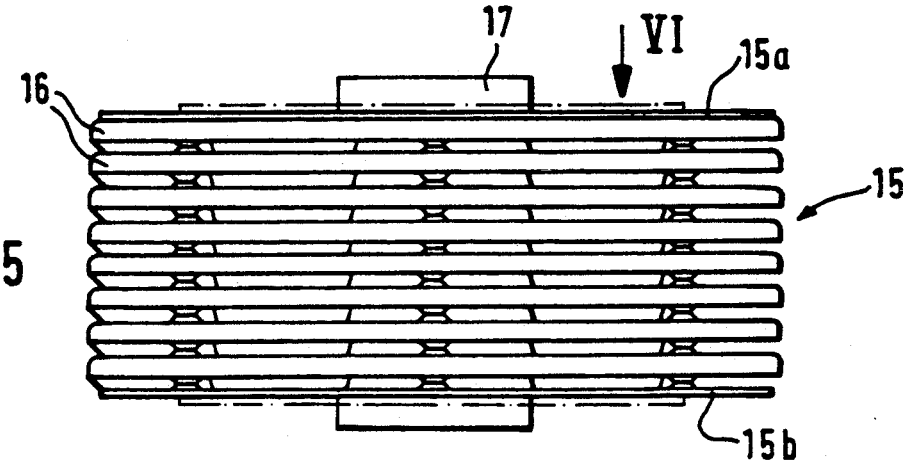

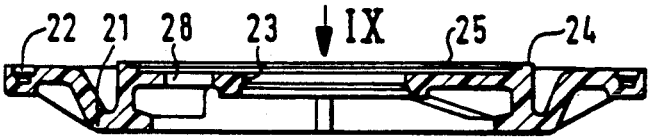
Fig. 8
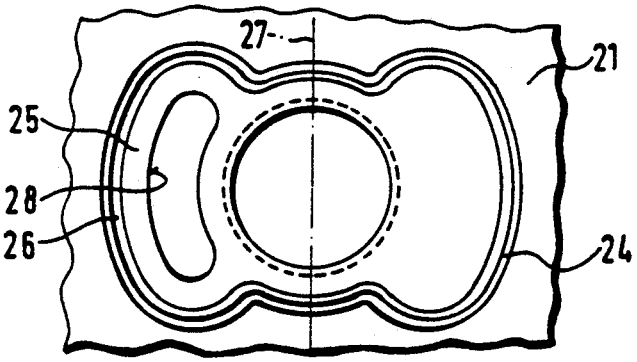
Fig. 9
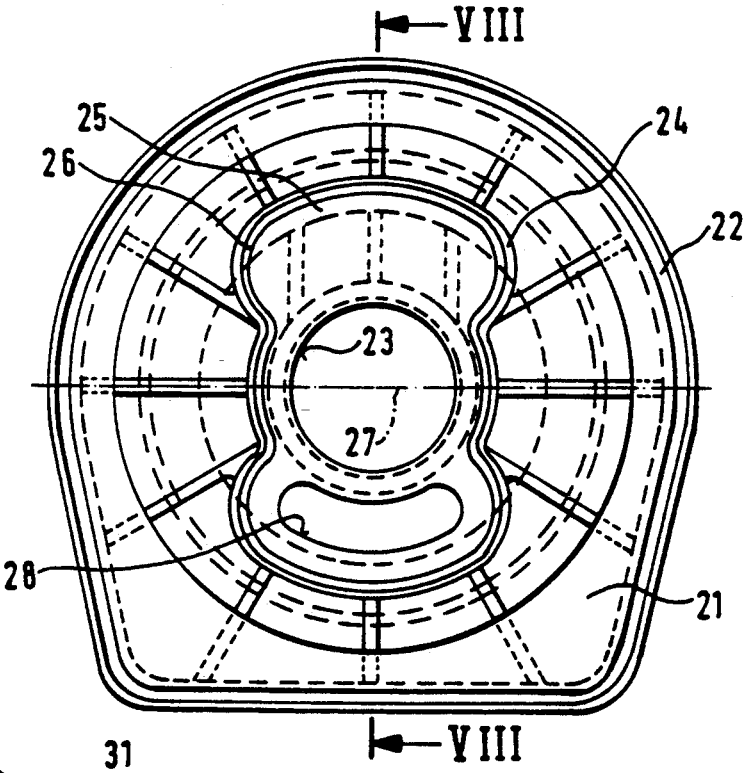
Fig. 10
Fig. 11
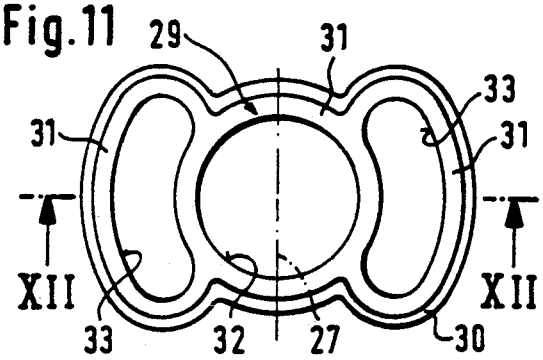
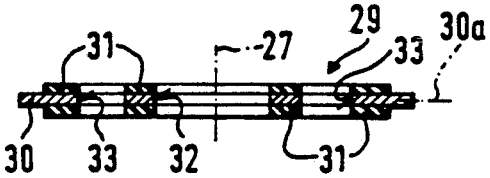
Fig. 12

HEAT EXCHANGER

BACKGROUND AND SUMMARY OF THE INVENTION

This invention relates to a heat exchanger, particularly an oil cooler, having a stack of disks comprising disk bodies which are stacked on top of one another and are connected with one another by flow-through openings and having a housing enclosing this stack of disks and having a plastic covering, one of the media subjected to the heat exchange respectively flowing through the stack of disks and the housing.

A heat exchanger of this type is known (European Patent Document EP 0 124 217 A1). In the case of this known construction, the disk bodies are first tightly soldered to the two disks forming the later bottom and lid, and subsequently the plastic covering is pushed from the direction of the side of the lid over the still upright edge of the lid with the insertion of a sealing device, into a bottom edge, after which the upright lid edge, also with the insertion of a sealing device, is folded over around the other front side of the covering. This type of manufacturing and mounting of the plastic housing ring on the presoldered basic body results in high expenditures.

It is an object of the invention to develop a heat exchanger of the initially mentioned type in such a manner that the folding-over of the lid and the bottom about the plastic covering and the relatively complicated placing of the plastic covering on the stack of disks will not be necessary. In order to achieve this object, it is provided in the case of a heat exchanger of the initially mentioned type that the bottom and the lid of the housing are also made of plastic, are provided with one fitted sealing device for the sealing on the stack of disks, and are welded to the front sides of the covering, in which case a stop edge is assigned to each sealing device for resting against the stack of disks, and the sealing device is prestressed between the stack of disks and the bottom or lid.

Because of this development, only the stack of disks has to be soldered and is then, as a result of the welding of the lid and of the bottom to the covering, sealed off sufficiently with respect to the lid and the bottom and thus also with respect to the second heat exchange medium. Although it is basically known from the German Patent Document DE 32 47 502 A1 to weld a tube bottom of a heat exchanger made of plastic to a radiator tank made of plastic, the fitting of a sealing device between parts of the plastic bodies, which are to be welded together, does not play a role there. In contrast, the invention suggests a simple construction of a stack of disks which is to be securely sealed off with respect to a housing, in which case this sealing-off previously had taken place exclusively by soldering.

In certain preferred embodiments, it is particularly advantageous for the bottom and the covering to form a one-piece pot-shaped housing onto which only the plastic lid must then still be welded. It is also advantageous according to certain embodiments for the sealing device to be fitted in each case into a recess on the bottom of the housing and in the lid in which case the stop edge may surround this recess. In this case, it is definitely possible to mount the sealing material in a strip shape directly on areas of the recess in such a manner that the desired sealing effect is achieved when the lid is welded to the housing.

However, it is also particularly advantageous in certain embodiments for the sealing device to be mounted as a strip of a sealing material on a thin carrier material, the contour of which is adapted to the recess. The reason is that, in this case, it is sufficient for the sealing device to be placed in the recess surrounded by the stop edge. Advantageously the sealing material may in each case be mounted as closed ring strips on both sides of a carrier foil serving as the carrier material. The stack of disks is inserted and the lid to be mounted which is also provided with a carrier foil with the sealing material is pressed against the housing for so long until in each case the stop edges rest upon one another during the welding operation. In this case, the sealing material may simply be sprayed onto the carrier foil in a strip shape, and these sealing strips may advantageously be applied mirror symmetrically with respect to a plane which extends through the center of the carrier foil and in parallel to its surfaces provided with the sealing material. Since the carrier needs to be only very thin, this results in an easily handled elastic sealing device which can be placed and fitted precisely into the recesses provided for this purpose so that the mounting becomes very simple.

Advantageously, the dimensions of the stop edge and of the recess, on the one hand, and the dimension of the carrier foil and the applied sealing strip, on the other hand, may be coordinated such with respect to one another that the sealing material, after the welding-together of the lid and the housing, is compressed to approximately 60% of its initial thickness and thus is desirably and sufficiently prestressed. In this case, the lid and the bottom may expediently be connected with the covering, or the lid may be connected with the housing, by means of ultrasonic welding, in which case the zones to be welded together, connect with one another while being softened, and the axial force applied in this welding operation is limited by the stop edges which impact on one another. The prestressing which is achieved then, is sufficient on the one hand for achieving a secure sealing with respect to the second heat exchange medium. However, on the other hand, it is also not excessively high to carry the risk of a premature fatigue of the sealing material. Silicone has proven to be useful as the sealing material and, in a simple manner, can be sprayed onto the carrier foil.

Other objects, advantages and novel features of the present invention will become apparent from the following detailed description of the invention when considered in conjunction with the accompanying drawings.

BRIEF DESCRIPTION OF THE DRAWINGS

FIG. 1 is a lateral view of a pot-shaped housing for the manufacturing of an oil cooler, constructed according to a preferred embodiment of the invention;

FIG. 2 is a top view in the direction of the arrow II of the housing of FIG. 1;

FIG. 3 is a sectional view of the housing of FIG. 1 taken along Line III—III;

FIG. 4 is a view of the interior side of the bottom of the top of the housing of FIG. 3, taken in the direction of arrow IV;

FIG. 5 is a lateral view of a stack of disks for the manufacturing of a heat exchanger according to the invention;

FIG. 8 is a sectional representation along Line VIII—VIII of FIG. 10 of the lid of FIG. 7;

FIG. 9 is a view of the interior side of the lid of FIGS. 8 and 10 viewed in the direction of the arrow IX;

FIG. 10 is a view of the whole lid of FIG. 8, also viewed in the direction of the arrow IX;

FIG. 11 is a top view of a sealing device which can be placed between the housing bottom or lid and the stack of disks according to FIG. 7; and FIG. 12 is a sectional view of the sealing device of FIG. 11 along Line XII—XII.

DETAILED DESCRIPTION OF THE DRAWINGS

Figure 6:
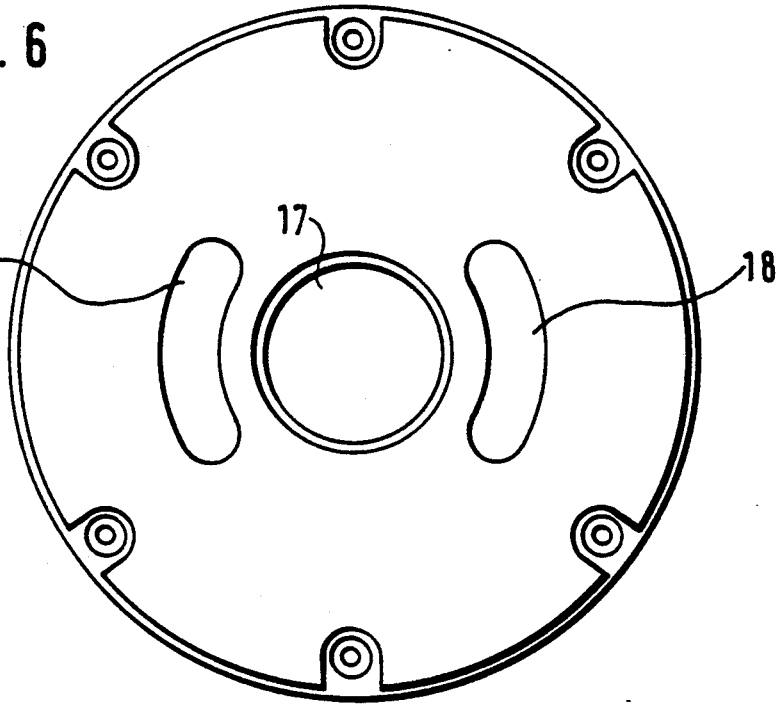
FIG. 6 is a top view in the direction of the arrow VI of the stack of disks of FIG. 5.

FIGS. 1 to 3 illustrate a pot-shaped housing 1 which is provided with two connecting tubes 2 and 3 for the flowing-in and flowing-off of a heat exchange medium, in this case, a coolant, which project toward the outside from the direction of a flattened housing side 1*a*. The housing 1 is made of a plastic material and is provided with bottom 6 which has several reinforcing ribs 4 and 5 and a central opening 7. The housing 1 has an essentially circular pot shape, with the exception of the flattened wall 1*a* and its lateral transitions. Free edge 8 of housing, which is situated opposite the bottom 6, has a thinner reinforced edge 8*a* which projects toward the outside from the front side of the edge 8 and which, as will be explained later, is used for the welding-together with a plastic lid. In addition, on the bottom 6 of the housing and on its outer side between two surrounding concentric reinforcing ribs 4 and 5, a groove 9 is provided for receiving a sealing device which is used for the sealing-off with respect to a connecting part, such as the engine, the oil of which is to be cooled. FIGS. 3 and 4 show that, on the inside of the bottom 6, two inwardly projecting pins 10 and 11 are provided which have the purpose of aligning the stack of disks, which is later inserted into the housing 1, according to FIGS. 5 and 6 in its position inside the housing.

However, as also shown in FIG. 4, on the inside of the bottom 6, a recess 14 with a flatter edge 13 is provided which surrounds a stop edge 12 and has the purpose of fittingly receiving a flat sealing device 29, as it is illustrated and explained in FIGS. 11 and 12.

Figure 7:
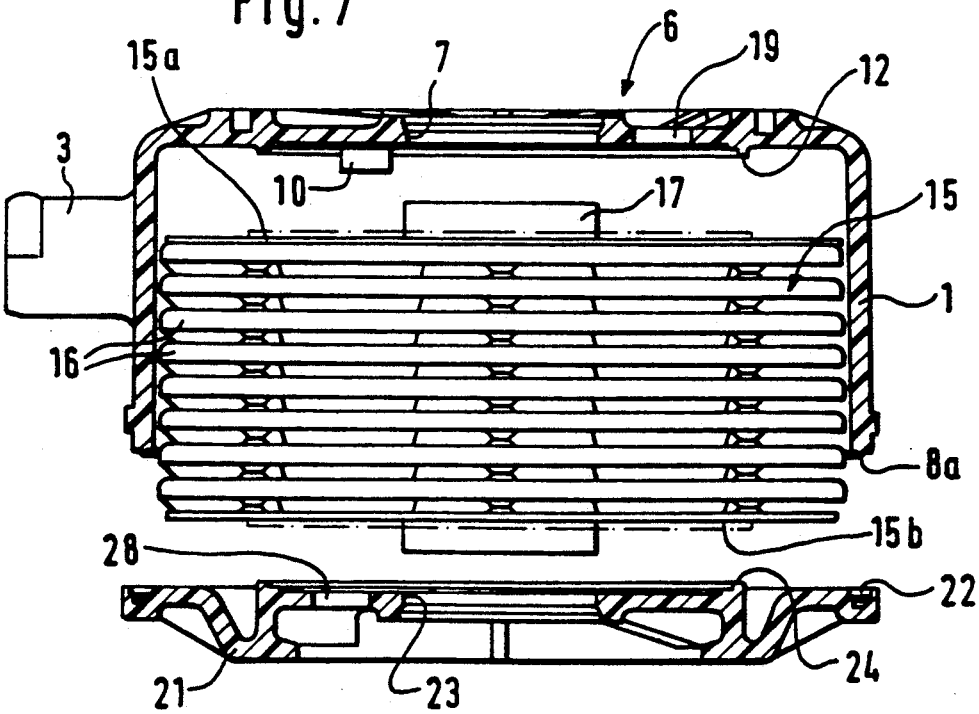
FIG. 7 is a schematic representation of the installation of the stack of disks of FIG. 5 into the housing of FIG. 3 and the arrangement of a lid closing off the housing in the sectional representation of FIG. 8.

FIGS. 5 and 6 show the stack 15 of disks which—according to FIG. 7—is to be inserted into the housing 1 and which, in a known manner, comprises several hollow disk bodies which are stacked on top of one another and are soldered together with one another. A tube piece 17, which projects out of the stack 15 of disks on the top and on the bottom, extends through the center of all disk bodies. These projecting parts of the tube 17, during the installation of the stack 15 of disks, are inserted into the opening 7 of the housing 1 and into an opening 23 of a lid which will be explained by means of FIGS. 8, 9 and 10. On the sides, which are diametrically at opposite sides at the tube 17, all disk bodies 16 have two kidney-shaped oblong holes 18 which have the purpose of, on the one hand, connecting the interiors of all disk bodies 16 with one another and, on the other hand, also establishing the connection to the inflow ducts and outflow ducts, which are not shown in detail, for the second heat exchange medium, in the present case, for oil.

FIGS. 4 and 7 illustrate that the pins 10 and 11, when the tube piece 17 projects into the opening 7 of the housing 1, in turn, project into one of the two kidney-shaped openings 18 and, in this manner, since they rest against the ends of the oblong hole 18, provide a precise securing of the position of the stack 15 of disks in the housing 1. By means of this alignment, the oblong hole 18, which is situated on the right side in FIG. 6, becomes congruent with an also kidney-shaped oblong hole opening 19 in the bottom 6 of the housing 1 so that through this opening 19, for example, the inflow of the oil to be cooled into the stack 15 of disks can take place. On the other side of the stack 15 of disks, the oil can, in turn, flow off through the opening 28 in a lid 21 which is situated opposite the tube piece 17 diametrically to the opening 19, and can, through a filter which is not shown, flow back into the tube 17 and from there to the engine. However, this recirculating of the oil itself is not the object of the present invention and therefore not further described herein.

The lid 21 is also made of plastic, specifically expediently of the same plastic as the housing 1. At its outer edge, the lid has a surrounding groove 22 into which the edge 8 and 8*a* of the housing 1 can be guided and can be connected with the lid 21, for example, by means of ultrasonic welding. As shown in FIG. 10, the lid 21 has on its outside also radially and concentrically extending reinforcing ribs which provide the lid with the necessary stability. In its center, it is provided with an opening 23, the diameter of which corresponds to the diameter of the opening 7 and is adapted to the diameter of the tube 17.

On its inside, the lid 21 is also provided with a surrounding stop edge 24 which, as in the case of the bottom 6 of the housing 1, surrounds a recess 25 with a flatter edge 26 which borders it. This recess 25 has a shape which is symmetrical with respect to a longitudinal center plane 27 (FIG. 10) and which may be considered as corresponding approximately to the shape of an eight ("8") with a central bulged part. In one half of this recess 25, a kidney-shaped oblong hole 28 is arranged which, in its shape, corresponds to the oblong holes 18 of the stack 15 of disks and which, as indicated above, has the purpose of permitting the outflow of the oil, which flowed through the disk bodies 16 of the stack 15 of disks, into a deflecting or filter space from where it can then be guided through the tube 17 of the stack 15 of disks back to the starting point, as a rule, to the engine. With the exception of the position of the oblong holes 28 and 19, the recesses 13, 14 in the bottom 6 and the recesses 26, 25 in the lid 21 correspond to one another.

In order to cause the sealing-off of the stack 15 of disks in the area of the oblong holes 18 with respect to the assigned inlet openings 19 in the housing 1 or with respect to the outlet opening 28 in the lid 21, the sealing device 29 illustrated in FIGS. 11 and 12 is provided which is made of a thin carrier foil 30 of metal or of a sufficiently stiff plastic material, onto which strips 31 made of a sealing material, such as silicone, are sprayed which extend around on both sides. In the case of the embodiment, as particularly shown in FIG. 11, the sealing strip has a contour of a central ring which surrounds a circular opening 32 in the carrier foil 30 and is supplemented by ear-shaped projections toward both sides which surround kidney-shaped openings 33 in the carrier foil 30, the shape of which is, in turn, adapted to the shape of the openings 28 in the lid or 19 in the bottom 6 of the housing 1. In this case, the carrier foil may be made of a material of an approximate thickness of 0.5 mm which, on both sides, mirror-symmetrically to a plane 30*a* extending through the center of the carrier foil 30 and in parallel to its surfaces provided with the sealing strips 31, is provided with the sealing strips 31 in a uniform layer thickness of approximately 0.4 mm. It is known that the silicone can be sprayed on in a very precisely apportioned manner so that the sealing device 29 can be manufactured in a very simple manner while using a carrier material.

For the mounting, the sealing device 29 will then, on the one hand, be placed in the recess 13, 14 of the housing 1, and a second sealing device will be placed in the recess 25, 26 in the lid 21. In the process, the carrier foil is placed on the flatter bordering 13 and 26 in the bottom and in the lid and is centered there, while the sealing strip 31 projecting away from the carrier foil each extend into the deeper recess 14 of the bottom 6 or 25 of the lid 21. In this case, the dimensions are such that the recess 14 is not much deeper than the surrounding edge 13 on the bottom 6, and the stop edge 12 projects only so far from the bottom 6 against the stack 15 of disks that it will then come to rest against the stack of disks when the two sealing strips 31 applied symmetrically to the carrier foil 30 of FIG. 11 and 12 are uniformly compressed to approximately 60% of their original initial thickness. This condition will occur when, according to FIG. 7, the stack 15 of disks, with the insertion of the sealing devices 29, rests, on the one side, with its upper contact surface 15*a* on the stop edge 12 of the bottom 6 of the housing 1, and, on the other side, against the surrounding stop edge 24 of the lid 21 with the contact surface 15*b*. In this case, the edge 8, 8*a* of the housing 1 is also received in the groove 22 of the lid 21 and is fixedly welded ultrasonically to the lid. The whole disk oil cooler according to the embodiment of the invention will then be finished.

It is also contemplated to mount the sealing strips 31 in the shown form not on a separate carrier foil 30 and then place them non-rotatably in the lid and the bottom, but to mount the sealing strips directly to the desired extent around the openings 7 and 23 and around the openings 19 and 28. When suitable dimensions are selected, it would then also be possible to compress the thus formed sealing device to 60% of its original thickness and to provide it with a prestress which is sufficient for applying the necessary sealing force, but, on the other hand, is not too large in order to contribute to an early fatigue of the elasticity. In the case of the selected embodiment and when a sealing device 29 is used, the sealing device may, however, be produced in series and separately from the two plastic parts of the housing 1. It is therefore also provided with two oblong hole openings 33 situated opposite the opening 32 so that it can be used for the bottom 6 as well as for the lid 21, without the requirement of taking care during the inserting that the opening in the sealing device is also assigned to the opening in the bottom or in the lid.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method of manufacturing a heat exchanger of the type including a stack of disk bodies stacked on top of one another and connected with one another by flow through openings and a housing enclosing the stack of disk bodies, the housing and disk bodies defining flow openings for respective heat exchange fluids, said method comprising:

forming a plastic housing bottom part, forming a plastic housing lid part, forming a fitted sealing device, forming a stack of disk bodies, placing the fitted sealing device between an end of the stack of disk bodies and one of the housing bottom part and housing lid part, and welding the housing bottom part to the housing lid part with the stack of disk bodies and sealing device enclosed therebetween and compressing the sealing device.

2. A method according to claim 1, wherein the sealing device is positioned in a recess having a stop edge on the bottom part and the lid part.

3. A method according to claim 2, wherein the sealing device includes a strip of compressible sealing material on a thin material carrier, the contour of which carrier is adapted to the recess.

4. A method according to claim 3, wherein the sealing material is, in each case, applied as closed ring strips to both sides of a carrier foil serving as the carrier material.

5. A method according to claim 4, wherein the dimensions of the stop edge and of the recesses, on the one hand, and the dimension of the carrier foils and of the applied sealing strips, on the other hand, are coordinated with one another such that, after the welding-together of the lid part and the housing bottom part, the sealing material is compressed to approximately 60% of its initial thickness.

* * * * *